US006313576B1

(12) United States Patent
Shirai et al.

(10) Patent No.: US 6,313,576 B1
(45) **Date of Patent: *Nov. 6, 2001**

(54) COLOR CATHODE RAY TUBE

(75) Inventors: Shoji Shirai, Mobara; Kenichi Watanabe, Ohtaki-machi; Masayoshi Furuyama, Tohgane, all of (JP)

(73) Assignees: Hitachi, Ltd., Tokyo; Hitachi Electronic Devices Co., Ltd., Mobara, both of (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/511,235

(22) Filed: Feb. 23, 2000

Related U.S. Application Data

(63) Continuation of application No. 09/015,791, filed on Jan. 29, 1998, now Pat. No. 6,051,919, which is a continuation of application No. 08/499,927, filed on Jul. 10, 1995, now Pat. No. 5,739,630.

(30) Foreign Application Priority Data

Jul. 13, 1994 (JP) ..... 6-161333

(51) Int. Cl.[7] ..... H01J 29/70

(52) U.S. Cl. ..... 313/414; 313/412; 313/432; 315/368.15; 315/382

(58) Field of Search ..... 313/414, 412, 313/432, 439, 458, 460; 315/382.1, 368.15

(56) References Cited

U.S. PATENT DOCUMENTS

| | | |
|---|---|---|
| 4,581,560 | 4/1986 | Shirai et al. . |
| 4,886,999 | 12/1989 | Yamane et al. . |
| 5,015,910 | 5/1991 | Takahashi et al. . |
| 5,027,043 | 6/1991 | Chen et al. . |
| 5,061,881 | 10/1991 | Suzuki et al. . |
| 5,162,695 | 11/1992 | Shimoma et al. . |
| 5,300,855 | 4/1994 | Kweon . |
| 5,382,872 | 1/1995 | Kim et al. . |
| 5,394,053 | 2/1995 | Yun . |
| 5,506,468 | 4/1996 | Koh . |
| 5,532,547 | 7/1996 | Park et al. . |
| 5,539,278 | 7/1996 | Takahashi . |
| 5,814,929 | 9/1998 | Jo . |

FOREIGN PATENT DOCUMENTS

| | | |
|---|---|---|
| 5-266822 | 10/1993 | (JP) . |
| 3053828 | 4/2000 | (JP) . |

*Primary Examiner*—Ashok Patel
(74) *Attorney, Agent, or Firm*—Antonelli, Terry, Stout & Kraus, LLP

(57) ABSTRACT

A color cathode ray tube having an electron gun including an electron beam generating portion arrayed in a horizontal direction for generating three electron beams, and a main lens for focusing the three electron beams from the electron beam generating portion upon a fluorescent face. A final stage of the main lens is formed between a focusing electrode and an accelerating electrode. The focusing electrode is divided into at least two focusing electrode parts. A quadrupole electron lens is formed for each of the electron beams between a first focusing electrode part and a second focusing electrode part, and the strength of the quadrupole electron lens for the central electron beam is different from the strength of the quadrupole electron lens for the side electron beams. The second focusing electrode part has an aperture for the central electron beam and apertures for the side electron beams with a vertical dimension of the aperture for central electron beam being different from the vertical dimension of the apertures for the side electron beams. The focusing electrode which together with the acceleration electrode has the final stage of the main lens formed therebetween has a single aperture having a diameter which is larger in a horizontal direction than a diameter thereof in a vertical direction, and the focusing electrode has an electrode plate with an central electron beam aperture.

24 Claims, 8 Drawing Sheets

COLOR CATHODE RAY TUBE

CROSS REFERENCE TO RELATED APPLICATION

This is a continuation of U.S. application Ser. No. 09/015,791, filed Jan. 29, 1998, now U.S. Pat. No. 6,051,919, which is a continuation of U.S. application Ser. No. 08/499,927, filed Jul. 10, 1995, now U.S. Pat. No. 5,739,630.

BACKGROUND OF THE INVENTION

1. Field of the Invention

The present invention relates to a color cathode ray tube to be used in a direct viewing type color TV receiver or a terminal color display and, more particularly, to a color cathode ray tube which has its resolution improved all over its screen area by improving the structure of a main lens for controlling the shape of an electron beam deflected to the peripheral portion of the screen.

2. Description of the Prior Art

In a color cathode ray tube, generally speaking, there are mounted in a vacuum enclosure made of glass or the like a fluorescent face formed of fluorescent films of fluorescent materials of three colors of red (R), green (G) and blue (B) colors, a shadow mask acting as electrodes for selecting color selecting electrodes elements, and an electron gun for emitting three electron beams, so that a predetermined color image is reproduced on the fluorescent face by modulating the aforementioned three electron beams with image signals of R, G and B colors.

FIG. 1 is a section for explaining the construction of a shadow mask type color cathode ray tube as the color cathode ray tube of this kind. Reference numeral 1 designates a panel portion; numeral 2 a neck portion; numeral 3 a funnel portion; numeral 4 a fluorescent film; numeral 5 a shadow mask; numeral 6 a mask frame; numeral 7 a magnetic shield; numeral 8 a shadow mask suspending mechanism; numeral 9 an in-line type electron gun; numeral 10 a deflection yoke; and numeral 11 an external magnetic device for centering and purity corrections.

In FIG. 1, the three electron beams (i.e., a central electron beam Bc and side electron beams Bs×2) emitted horizontally on one line (in-line) from the electron gun 9 are deflected by the horizontal and vertical magnetic fields, which are generated by the deflection yoke 10 mounted on the transitional region between the funnel portion 3 and the neck portion 2, and have their colors selected by the apertures of the shadow mask 5 until they impinge upon the predetermined fluorescent materials.

The shadow mask 5 is supported by the mask frame 6 and is suspended and held on the inner wall of the skirt portion of the panel portion through the suspending mechanism fixed on that mask frame.

On the mask frame 6, there is mounted the magnetic shield 7 which has a function to shield the electron beams from the external magnetic fields (e.g., the terrestrial magnetism) thereby to prevent the impinging positions of the electron beams from being displaced by the external magnetic fields.

In this color cathode ray tube, the resolution at the screen periphery is deteriorated due deflection defocusing caused by the self convergence deflection yoke. With the self convergence deflection yoke, the center and side beams can converge all over the screen. However, the yoke has the strong astigmatism that overfocuses the electron beams in the vertical cross section and extends the vertical spot size.

In order to reduce the deterioration of the resolution, the structure of the focusing lens system of the electron gun has been improved.

FIG. 2*a* is a schematic diagram, as taken in section along the tube axis, for explaining the construction of an electron gum according to the prior art for improving the resolution; FIG. 2*b* is a section as taken along line 101—101 of FIG. 2*a*; and FIG. 2*c* is a front elevation of an electrode plate. Reference numeral 21 designates a cathode; numeral 22 a $G_1$ electrode; numeral 23 a $G_2$ electrode; numeral 24 a focusing electrode; numeral 25 an accelerating electrode; and numeral 26 a shielding cup.

In these Figures, the cathode 21, the $G_1$ electrode 22 and the $G_2$ electrode 23 constitute an electron beam generating portion, from which the electron beams are emitted along the initial passages arranged generally in parallel with a horizontal plane until they impinge upon the main lens portion.

This main lens portion is constructed of the focusing electrode 24 acting as the main lens electrode, the accelerating electrode 25 and the shielding cup 26.

The focusing electrode 24 is divided into a first kind of focusing electrode 241 and a second kind of focusing electrode 242, the former of which is formed with a single horizontally elongated aperture and equipped therein with an electrode plate 245 having three circular electron beam passing holes.

On the other hand, the second kind of focusing electrode 242 is formed with three circular electron beam passing holes at the end face confronting the first kind of focusing electrode 241. To the second kind of focusing electrode 242, there are attached plate-shaped correcting electrodes 243 (as will also be shortly called the "plate electrodes") which are extended toward the first kind of focusing electrode 241 in parallel with the array direction of those electron beam passing holes.

The electron beam passing holes of the electrode plate 245 and the focusing electrode 242 are given common axes and diameters for the individual electron beams.

The plate-shaped correcting electrode and the electrode plate 245 have their electron beam passing holes confronting each other to form the electrostatic quadrupole lens.

Moreover, the first kind of focusing electrode 241 is supplied with a constant focusing voltage Vf at 5 to 10 kV, and the second kind of focusing electrode 242 is supplied with a dynamic voltage Vd in superposition over the constant focusing voltage Vf. On the other hand, the accelerating electrode 25 is supplied with a final accelerating voltage at 20 to 35 kV.

The aforementioned dynamic voltage Vd has a waveform in which a parabolic waveform having a period of the horizontal deflection period 1H and a parabolic waveform having a period of the vertical deflection period 1V of the electron beams are synthesized.

When the electron beams are not deflected at the central portion of the screen, the dynamic voltage drops to 0 so that not only the potential difference between the first kind of focusing electrode 241 but also the second kind of focusing electrode 242 but also the electrostatic quadrupole lens action substantially disappear. When the electron beams are deflected toward the screen corner portions (i.e., the peripheral portions), on the other hand, the dynamic voltage is maximized to maximize not only the potential difference between the first kind of focusing electrode 241 and the second kind of focusing electrode 242 but also the electrostatic quadrupole lens action.

When the electron beams are thus deflected, the dynamic voltage Vd is raised according to the increase in the deflection. As this dynamic voltage Vd rises, the quadrupole lens to be formed in the confronting portion between the first kind focusing electrode 241 and the second kind of focusing electrode 242 is intensified to correct the astigmatism resulting from the electron beam deflection.

At the same time, the voltage difference between an accelerating voltage Eb of the accelerating electrode 25 and the voltage applied to the second kind of focusing electrode 242 can be reduced to elongate the distance between the main lens and the electron beam focal point to focus the electron beams even on the screen peripheral portion.

By employing such electron gun, the resolution of the screen peripheral portion of the color cathode ray tube is drastically improved.

Specifically, the astigmatism to horizontally extend the electron beams deflected to the screen periphery by the self-converging magnetic field is corrected by the astigmatism to vertically extend the electron beams by the electrostatic quadrupole lens. At the same time, the corrections are also made upon the field curvature aberrations.

This field curvature aberration is an aberration which will deteriorate the resolution because the focusing conditions go out of the optimum ones in the screen periphery when the electron beam is focused in optimum at the screen center due to the difference between the distance to the screen center and the distance to the screen periphery from the main lens.

The intensity of the main lens final stage lens to be formed between the accelerating electrode and the second kind of focusing electrode when the dynamic voltage is applied is reduced so that the deflected electron beams can be focused in optimum in the screen periphery to correct not only the astigmatism but also the field curvature aberration.

Incidentally, if the electron gun having that electrostatic quadrupole lens is used, the action (i.e., the so-called "STC: Static Convergence") to converge the three electron beams upon the screen by the main lens final stage lens fluctuates with the fluctuation of the dynamic voltage Vf, to raise a problem of the convergence misalignment.

In the electrode structure of the type described with reference to FIG. 2*a*, this problem of convergence misalignment is solved by fluctuating the STC in the opposite direction at the electrostatic quadrupole lens portion to mutually cancel the STC fluctuations at the main lens final stage lens.

In the color cathode ray tube using the electron gun of the aforementioned type, however, the following problems arise due to the electrode construction of the electron gun.

Specifically, in order to fluctuate the STC by the electrostatic quadrupole lens, the horizontal electric field is applied to only the side electron beams so that these side electron beams are horizontally moved.

FIG. 3 is a section of an electrostatic quadrupole lens portion of the electron gun shown in FIG. 2*a* for explaining the operations of the same.

In FIG. 3, the plate electrodes 243 are fitted in the first kind of focusing electrode 241 and connected with the second kind of focusing electrode. Reference numeral 201 designates equipotential lines indicating the potential distribution which is established in the section of the plate electrodes 243, and numerals 202, 203 and 204 designate the same electric fields.

The electric field 202 to be established in the sections of the plate electrodes 243 contains not only the horizontal component 203 but also a small quantity of the vertical component 204 to be established by the quadrupole lens effect, so that the electrostatic quadrupole lens is intensified against the side electron beams to cause an unbalance from the astigmatism correction sensitivity for the central electron beam.

As a result, if the dynamic voltage is set to such a proper value as to correct the astigmatism of the side electron beams in the screen periphery, the astigmatism cannot be corrected for the central electron beam. If, on the other hand, the dynamic voltage is set to a proper value for the central electron beam, the astigmatism in the quadrupole lens becomes excessive for the side electron beams. In either case, there arises a problem that the resolution in the screen peripheral portions is deteriorated.

SUMMARY OF THE INVENTION

An object of the present invention is to solve the aforementioned various problems of the prior art and to provide a color cathode ray tube which has its resolution improved at the central portion and peripheral portions of its screen.

The above-specified object is achieved by elongating or narrowing the plates of plate electrodes forming an electrostatic quadrupole lens, at the upper and lower portions of a passage for a central electron beam, or by making the shape of a central electron beam passing hole of such an electrode of a first kind of focusing electrode as is formed with electron beam passing holes, longer than the shape of electron beam passing holes for side electron beams, that is, by enlarging the ratio of the vertical diameter to the horizontal diameter.

The object is achieved by the following constructions 1 to 5, for example.

1. The plate electrode pair is shaped such that its lens intensity acts more upon the vertically upper and lower portions of the passage for a central one of said three electron beams than upon the vertically upper and lower portions of the side electron beam passages.
2. The plate electrode pair is made longer in the axial direction of said electron gun at the vertically upper and lower portions of the central electron beam passage of said three electron beams than at the vertically upper and lower portions of said side electron beam passages.
3. The plate electrode pair is more spaced at the vertically upper and lower portions of the central electron beam passage of said three electron beams than at the vertically upper and lower portions of said side electron beam passages.
4. The ratio of the horizontal diameter to the vertical diameter of a central electron beam passing hole, which is formed in such an end face of the electrodes belonging to said first kind of focusing electrode group forming said axially asymmetric electronic lens as confronts the electrodes belonging to said second kind of focusing electrode group for passing the central one of said three electron beams therethrough, is made larger than the ratio of the vertical diameter to the horizontal diameter of the side electron beam passing holes for passing the side electron beams therethrough.
5. The ratio of the horizontal diameter to the vertical diameter of a central electron beam passing hole, which is formed in such an end face of the electrodes belonging to said second kind of focusing electrode group forming said axially asymmetric electronic lens as confronts the electrodes belonging to said first kind of focusing electrode group for passing the central one of said three electron beams therethrough, is made smaller than the ratio of the vertical diameter to the horizontal diameter of the side electron beam passing holes for passing the side electron beams therethrough.

Thanks to the above-enumerated constructions of the present invention, the astigmatism correction sensitivity for the central electron beam can be increased to eliminate the unbalance from the astigmatism correction sensitivity for the side electron beams so that a proper dynamic voltage can be set for both the central electron beam and the side electron beams to provide an image display of high resolution all over the screen by eliminating the deterioration of the resolution in the screen peripheral portions.

DESCRIPTION OF THE PREFERRED EMBODIMENTS

The embodiments of the present invention will be described in detail in the following with reference to the accompanying drawings.

First Embodiment

Figure 1:
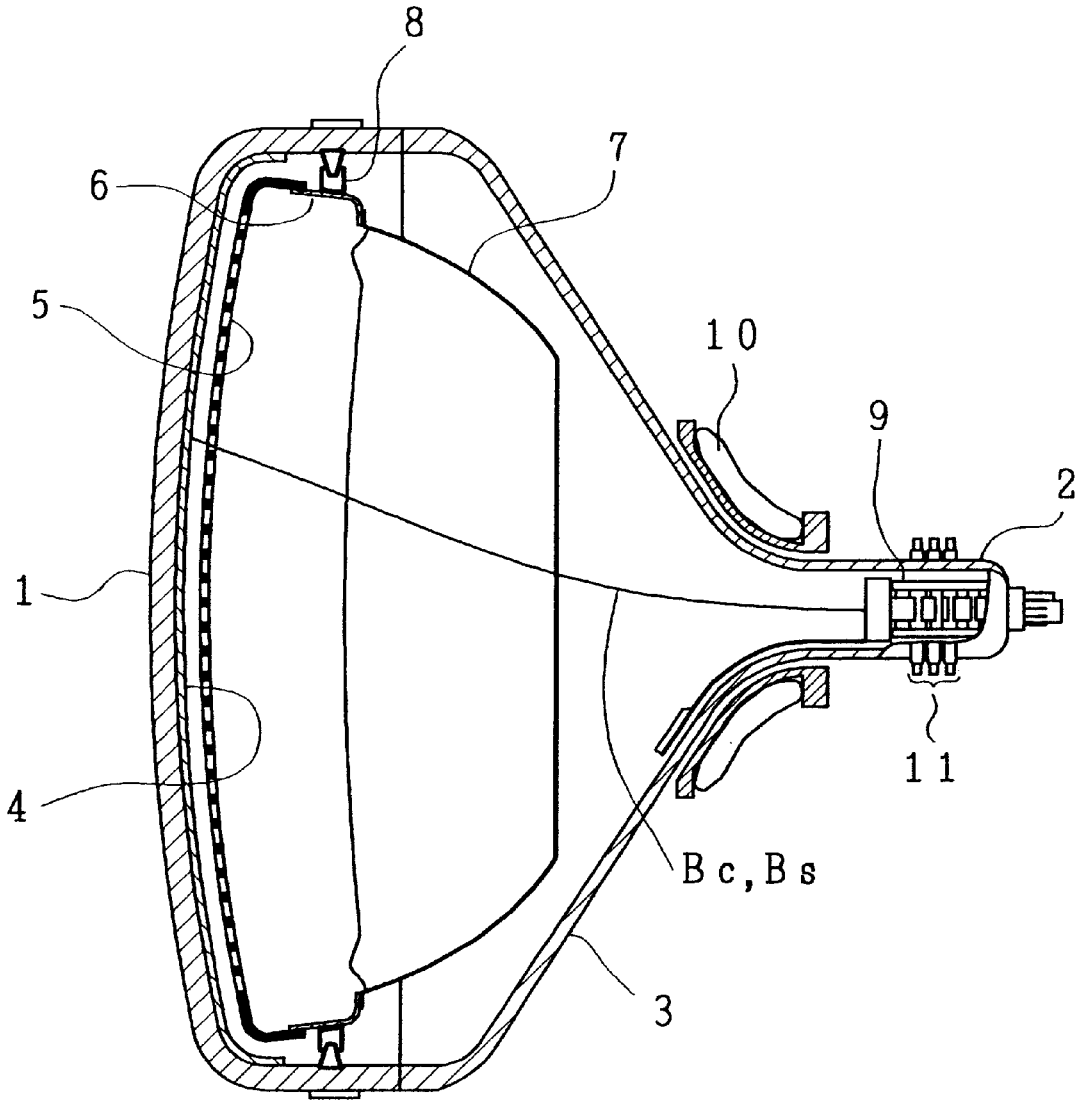
FIG. 1 (PRIOR ART)
FIG. 1 is a section for explaining the construction of a shadow mask type color cathode ray tube.
Figure 2A:
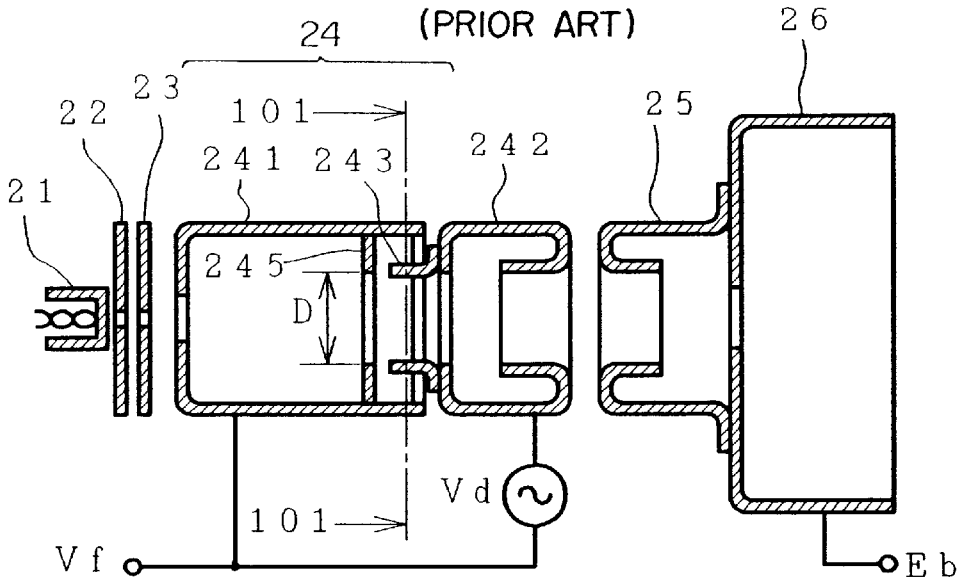
FIG. 2a (PRIOR ART)
FIG. 2*a* is a schematic diagram, as taken in section along the tube axis, for explaining the construction of an electron gum according to the prior art for improving the resolution.
Figure 2B:
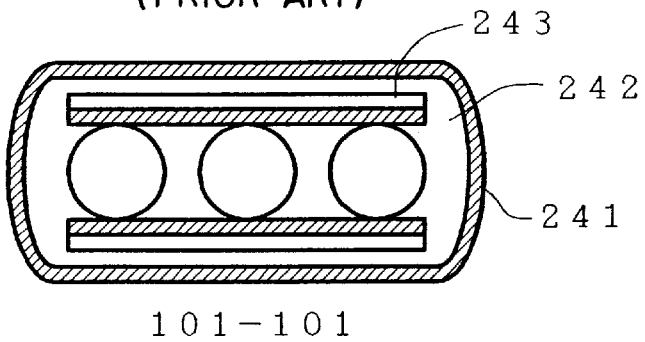
FIG. 2b (PRIOR ART)
FIG. 2*b* is a section as taken along line 101—101 of FIG. 2*a*.
Figure 2C:
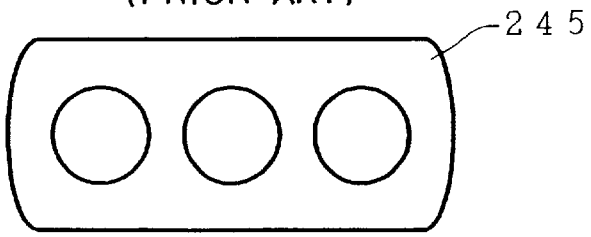
FIG. 2c (PRIOR ART)
FIG. 2*c* is a front elevation of an electrode plate constructing a focusing electrode.
Figure 3:
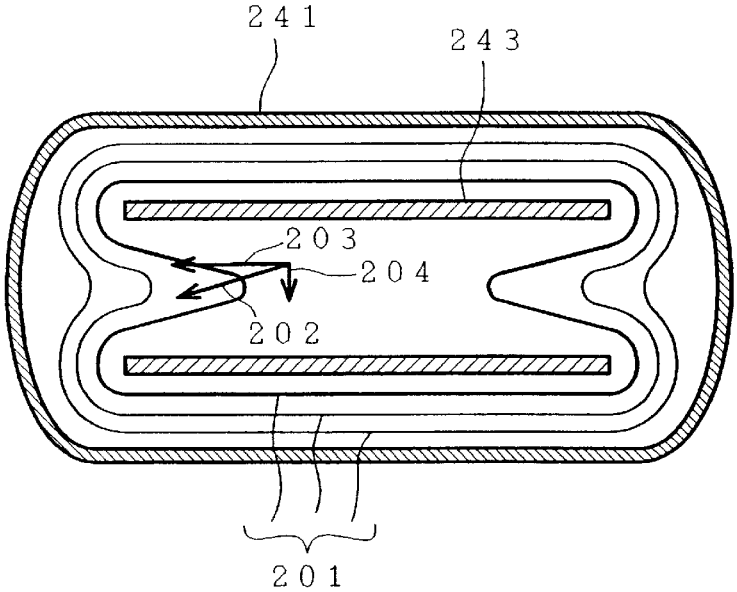
FIG. 3 is a section of an electrostatic four-pole portion of the electron gun shown in FIG. 2*a* for explaining the operations of the same.
Figure 4:
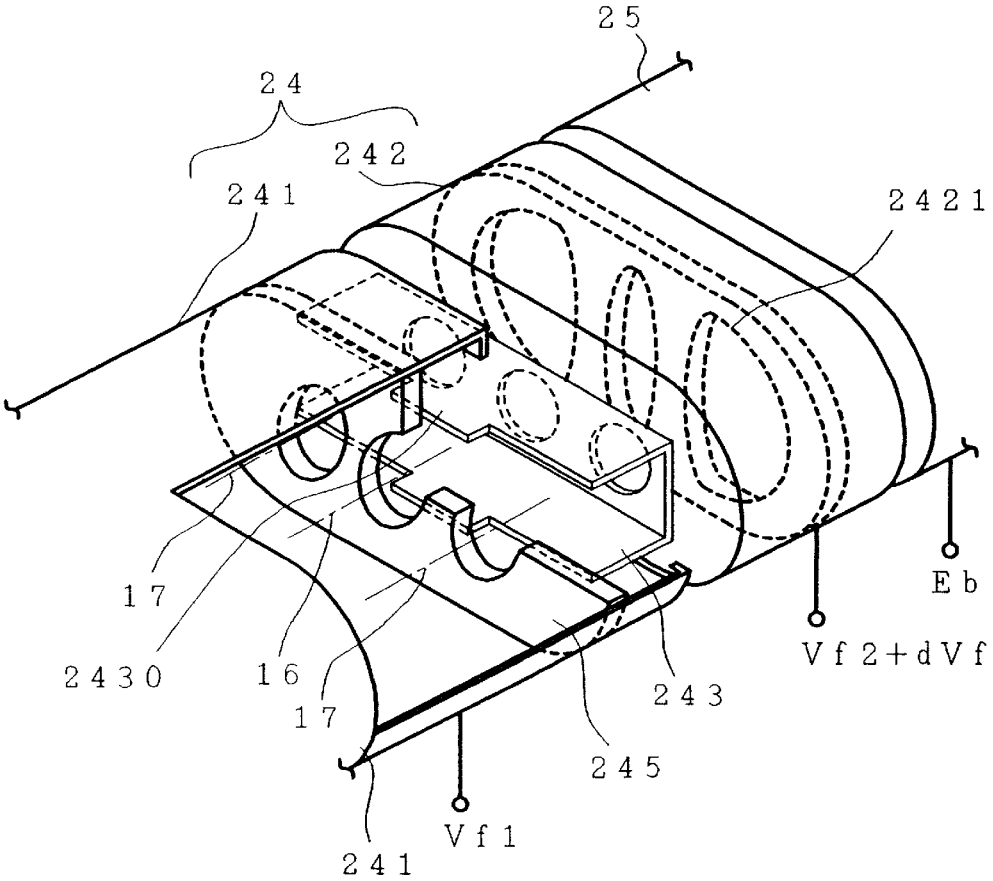
FIG. 4 is a broken diagram showing an essential portion of the focusing electrode portion of the electron gun for explaining a first embodiment of the color cathode ray tube according to the present invention.

FIG. 4 is a broken diagram showing an essential portion of the focusing electrode portion of the electron gun for explaining a first embodiment of the color cathode ray tube according to the present invention. Reference numeral 24 designates a focusing electrode; numeral 241 a first kind of focusing electrode; numeral 242 a second kind of focusing electrode; numeral 243 plate electrodes; numeral 245 an electrode plate having a central electron beam passage 16 and side electron beam passages 17 and 17; and numeral 25 designates an accelerating electrode.

The main lens is constructed of the first kind of focusing electrode 241 and the second kind of focusing electrode 242 constituting the focusing electrode 24, and the accelerating electrode 25.

The first kind of focusing electrode 241 is supplied with a first kind of focusing voltage $Vf_1$ at a constant level, and the second kind of focusing electrode 242 is supplied with a second kind of focusing voltage in which a dynamic voltage dvf fluctuating in synchronism with the deflection of the electron beam is superposed on a constant voltage $Vf_2$. Incidentally, the accelerating electrode 25 is supplied with a final accelerating voltage Eb at 20 to 30 kv, to form the final stage lens of the main lens between itself and the second kind of focusing electrode 242.

In FIG. 4, the main lens has its final stage lens constructed of an electrode plate 2421 which is formed with a single aperture having a large aperture in the electrode confronting face and with elliptical electron beam passing holes arranged in electrode, as disclosed in Japanese Patent Laid-Open No. 103752/1983.

This final stage lens structure is enabled to reduce the lens aberration and the beam spot diameter on the screen by making the lens aperture substantially larger than the ordinary cylindrical lens.

Between the first kind of focusing electrode 241 and the second kind of focusing electrode, there are arranged portions above and below (or vertically of) the central and side electron beam passages 16 and 17 and 17, to form the electrostatic quadrupole lens.

The electrostatic quadrupole lens structure thus made has portions 2430 which are formed above and below the central electron beam passage 16 of the plate electrodes 243 and made axially longer than the side electron beam passages 17.

Thanks to the presence of that portion 2430, the lens intensity against the central electron beam passage 16 is higher than that against the side electron beam passages 17.

According to this embodiment, more specifically, the lens intensity to act upon the central electron beam can be selectively increased to eliminate the unbalance in the astigmatism correction sensitivity.

Second Embodiment

Figure 5:
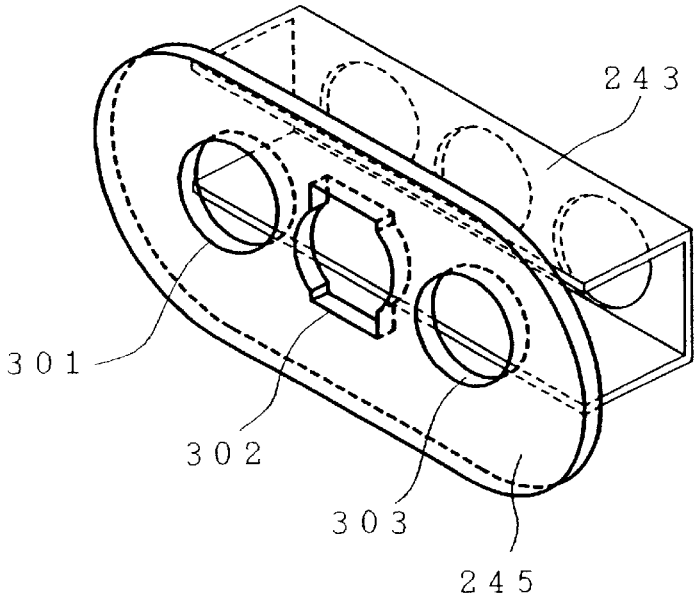
FIG. 5 is a perspective view showing an essential portion of the electron gun for explaining a second embodiment of the color cathode ray tube according to the present invention.

FIG. 5 is a perspective view showing an essential portion of the electron gun for explaining a second embodiment of the color cathode ray tube according to the present invention. Reference numerals 301, 302 and 303 designate electron beam passing holes.

In FIG. 5, the plate electrodes 243 forming the electrostatic quadrupole lens are connected with the second kind of focusing electrode and are inserted into the first kind of focusing electrode to confront the electrode plate 245.

Of the electron beam passing holes 301, 302 and 303 formed in the electrode plate 245, the central * electron beam passing hole 302 has its vertical diameter made larger than its horizontal diameter. The central electron beam passing hole 302 of the present embodiment is formed by vertically shortening a circular hole similar to the side electron beam passing holes 3Q1 and 303.

Thanks to this hole shape, the action to vertically diverge and horizontally focus the electron beam can be intensified to increase the quadrupole lens action thereby to eliminate the unbalance in the astigmatism correction sensitivity of the side electron beams.

According to this embodiment, more specifically, the lens intensity to act upon the central electron beam can be selectively increased to eliminate the unbalance in the astigmatism correction sensitivity.

Third Embodiment

Figure 6:
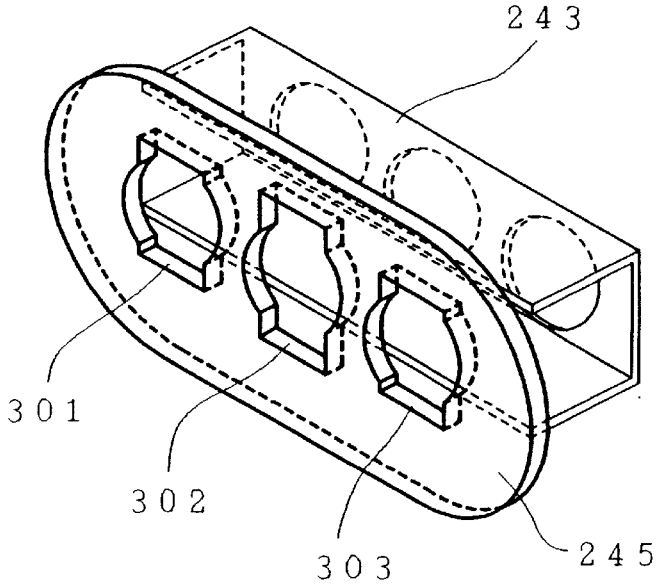
FIG. 6 is a perspective view showing an essential portion of the electron gun or explaining a third embodiment of the color cathode ray tube according to the present invention.

FIG. 6 is a perspective view showing an essential portion of the electron gun or explaining a third embodiment of the color cathode ray tube according to the present invention.

In this embodiment, the electrode construction is similar to that of the foregoing embodiment of FIG. 5. However, all the electron beam passing holes 301, 302 and 303 to be formed in the electrode plate 245 are given the same shape, and the central electron beam passing hole 302 has its vertical diameter made larger than that or the side electron beam passing holes 301 and 303.

Thanks to this hole shape, the action to vertically diverge and horizontally focus the electron beam can be intensified to increase the quadrupole lens action thereby to eliminate the unbalance in the astigmatism correction sensitivity of the side electron beams.

According to this embodiment, too, the lens intensity to act upon the central electron beam can be selectively increased to eliminate the unbalance which is caused in the astigmatism correction sensitivity.

The electron beam passing holes 301, 302 and 303 to be formed in the electrode plate 245 should not be limited to the shapes of the foregoing embodiments of FIGS. 5 and 6 but may be shaped to intensify the action to vertically diverge and horizontally focus the electron beam which has passed through the central electron beam passing hole, as in the known electron beam passing hole shapes such as elliptical or rectangular shapes or in their combinations.

Fourth Embodiment

Here will be described an embodiment in which the present invention is applied to an electron gun of a type different from those of the foregoing embodiments.

Figure 7:
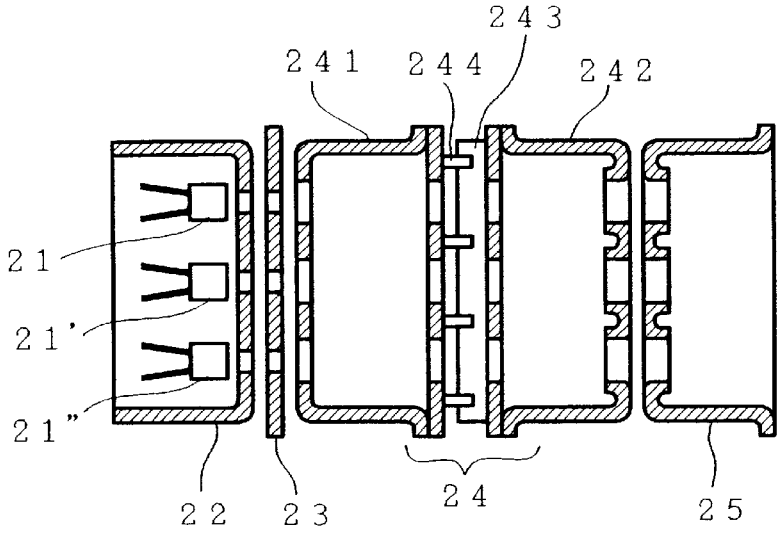
FIG. 7 is a section for explaining the structure of the electron gun which has an electrostatic four-pole lens equipped with plate electrodes at each of its divided focusing electrodes.

FIG. 7 is a section for explaining the structure of the electron gun which has an electrostatic quadrupole lens equipped with plate electrodes at each of its halved focusing electrodes. Reference numerals 21, 21' and 21" designate cathodes; numeral 22 a first grid electrode; numeral 23 designate a second grid electrode; numeral 24 a focusing electrode composed of a first kind of focusing electrode 241 and a second kind of focusing electrode 242; and numeral 25 an accelerating electrode.

On an electrode plate 245 of the first kind of focusing electrode 241 constituting the focusing electrode 24, as located at the side of the second kind of focusing electrode, there are so embedded first plate electrodes 244 in the direction of the second kind of focusing electrode as to horizontally interpose the individual electron beam passages. On the second kind of focusing electrode 242 as located at the side of the first kind of focusing electrode, on the other hand, there are embedded second plate electrodes 243 which are composed of a pair of plate members. The first plate electrodes 244 so vertically intersect the second plate electrodes 243 as to vertically interpose them to form the electrostatic quadrupole lens.

Figure 8:
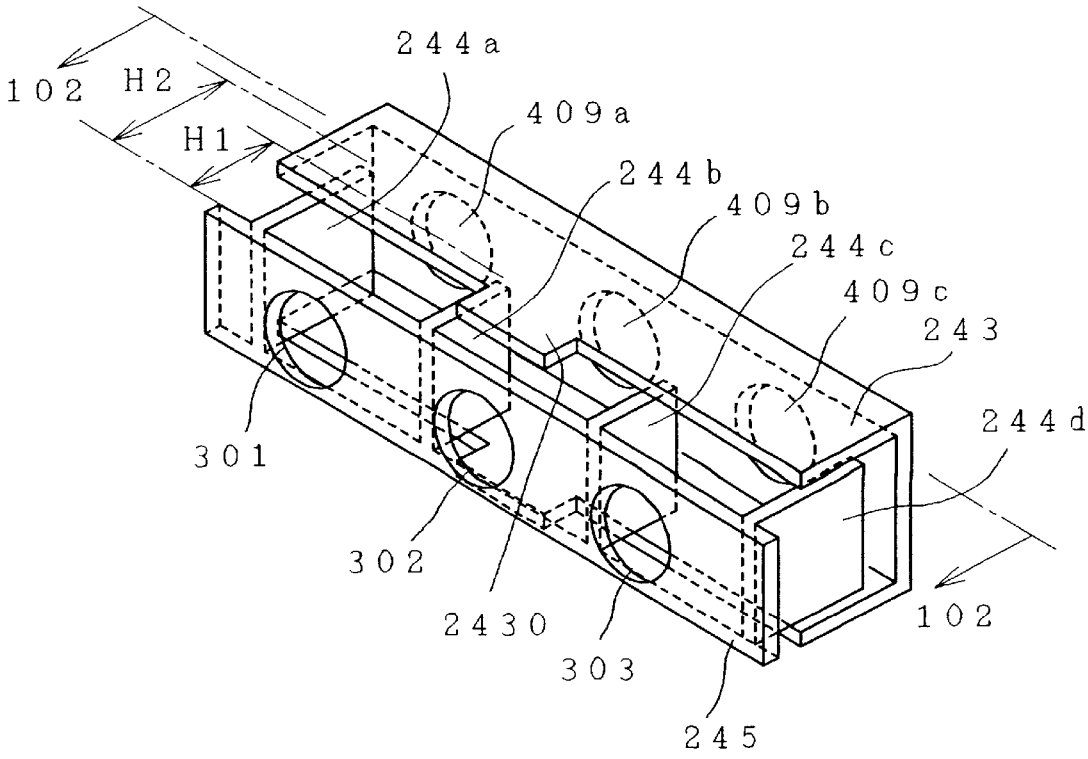
FIG. 8 is a perspective view showing an essential portion of the electron gun for explaining a fourth embodiment of the color cathode ray tube according to the present invention.

FIG. 8 is a perspective view showing an essential portion of the electron gun for explaining a fourth embodiment of the color cathode ray tube according to the present invention, and the present invention is applied to the electron gun of the type which has been described with reference to FIG. 7.

In FIG. 8: reference numerals 301, 302 and 303 designate electron beam passing holes which are formed in the electrode plate 245; numerals 244*a*, 244*b*, 244*c* and 244*d* first plate electrodes at the side of the first kind of focusing electrode; and numerals 409*a* and 409*b* and 409*c* electron beam passing holes which are formed in the second plate electrodes 243 at the side of the second kind of focusing electrode.

With the construction described above, in order to solve the fluctuation of the aforementioned STC, the second plate electrodes 243 are formed at their portions corresponding to the central electron beam with projecting portions 2430 which project toward the first kind of focusing electrode 241, as in the foregoing embodiment of FIG. 4. At the same time, the first plate electrodes 244*a*, 244*b*, 244*c* and 244*d* at the side of the first kind of focusing electrode are made shorter at $H_1$ for the central electron beam, as taken in the direction of the electron gun, than at $H_2$ for the site electron beams.

Figure 9:
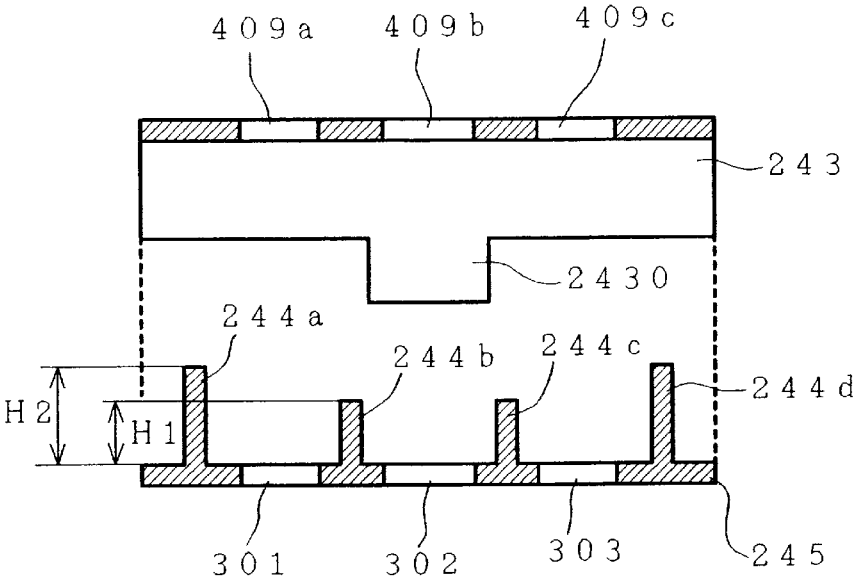
FIG. 9 is an exploded section taken along line 102—102 of FIG. 8.

FIG. 9 is an exploded section taken along line 102—102 of FIG. 8. As to the first plate electrodes 244*a*, 244*b*, 244*c* and 244*d* embedded on the electrode plate 245, the axial length $H_1$ of the plate electrodes 244*b* and 244*c* interposing the central electron beam passing hole 302 is made shorter than the axial length $H_2$ of the plate electrodes 244*a* and 244*d* located at the outer sides of the side electron beam passing holes 301 and 303.

Thanks to this construction, there can be established an electric field for deflecting the side electron beams toward the central electron beam to cancel the STC fluctuation by the main lens.

However, the mere shortening of the axial length of the aforementioned plate electrodes 244*b* and 244*c* will lower the intensity of the electrostatic quadrupole lens against the central electron beam. As a result, there arises a problem of an unbalance in the astigmatism correction effect for the central electron beam and the side electron beams, as has been described in connection with the embodiment of FIG. 4.

Therefore, the portions of the second plate electrodes 243 for the central electron beam are formed with the projecting portions 2430 projecting toward the first kind of focusing electrode 241 so that the reduction of the intensity of the electrostatic four-pole lens against the central electron beam is corrected to eliminate the unbalance in the astigmatism correction sensitivity from the side electron beams.

Incidentally, the present embodiment can be combined with the electron guns of the types shown in FIGS. 5 and 6, and the electrostatic quadrupole lens intensity against the central electron beam can be selectively increased by making the vertical diameter of the central electron beam passing hole larger than that of the side electron beam passing holes, so that the unbalance of the astigmatism correction sensitivity from the side electron beams can be eliminated.

On the other hand, the unbalance of the astigmatism correction sensitivity can be corrected by changing the shape of the central electron beam passing hole 409*b* at the side of the plate electrodes 243. In this case, the vertical diameter of the central electron beam passing hole 409*b* is made smaller than that of the horizontal diameter.

This is because the second plate electrodes 243 are connected with the second kind of focusing electrode so that their potential are inverted from that of the first plate electrodes 244. Specifically, the electrostatic quadrupole lens intensity is increased when the electron beam passing hole of the electrode supplied with a higher potential is horizontally elongated to the contrary of the lower-potential electrode.

Fifth Embodiment

Figure 10:
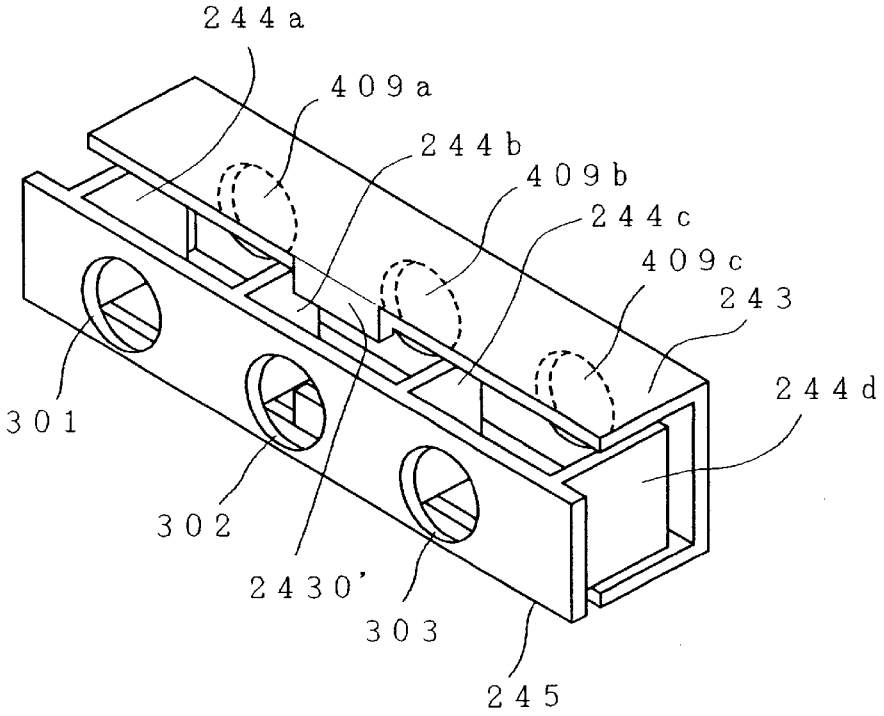
FIG. 10 is a perspective view showing an essential portion of the electron gun for explaining a fifth embodiment of the color cathode ray tube according to the present invention.

FIG. 10 is a perspective view showing an essential portion of the electron gun for explaining a fifth embodiment of the color cathode ray tube according to the present invention. This embodiment is different from that of FIG. 8 in that the second plate electrodes 243 connected with the second kind of focusing electrode are formed, at its portion corresponding to the central electron beam, with protruding portions 2430' which are folded toward said central electron beam.

Thanks to this construction, too, there can be attained effects similar to the aforementioned ones of FIG. 8.

Sixth Embodiment

Figure 11:
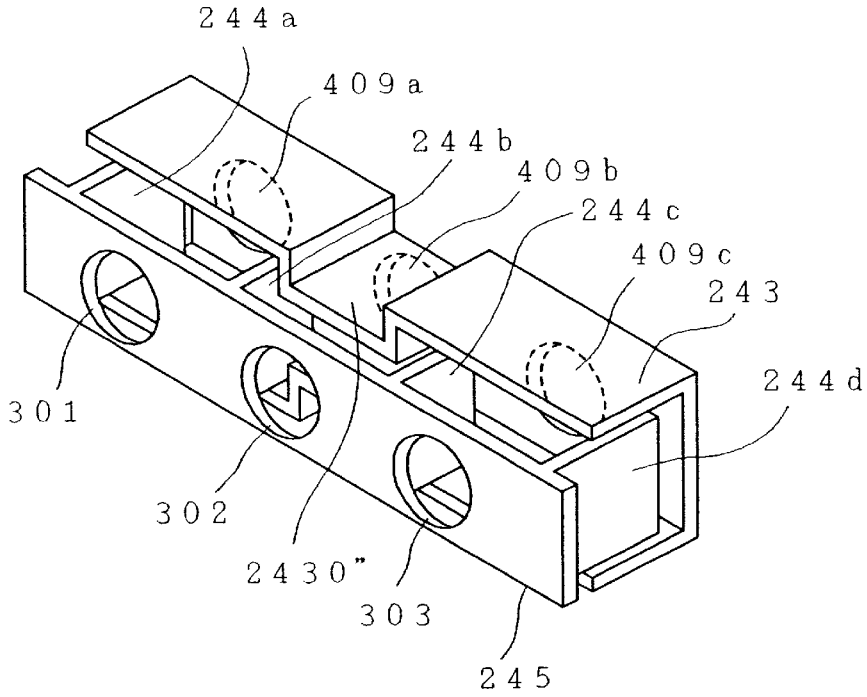
FIG. 11 is a perspective view showing an essential portion of the electron gun for explaining a sixth embodiment of the color cathode ray tube according to the present invention.

FIG. 11 is a perspective view showing an essential portion of the electron gun for explaining a sixth embodiment of the color cathode ray tube according to the present invention. What is different from the foregoing embodiment of FIG. 8 is that the second plate electrodes connected with the second kind of focusing electrode are formed, at its portion corresponding to the central electron beam, with step portions 2430" which are stepped toward said central electron beam.

Specifically, for the aforementioned paired plate electrodes, the central one of the aforementioned three electron beam passages has its vertical gap made smaller than that of the side electron beam passages.

This construction can also achieve effects similar to the aforementioned ones of FIGS. 8 and 10.

Incidentally, the constructions of FIGS. 10 and 11 can be applied to the electron guns of the types similar to those of FIGS. 5 and 6 as in the foregoing embodiments.

Seventh Embodiment

Figure 12:
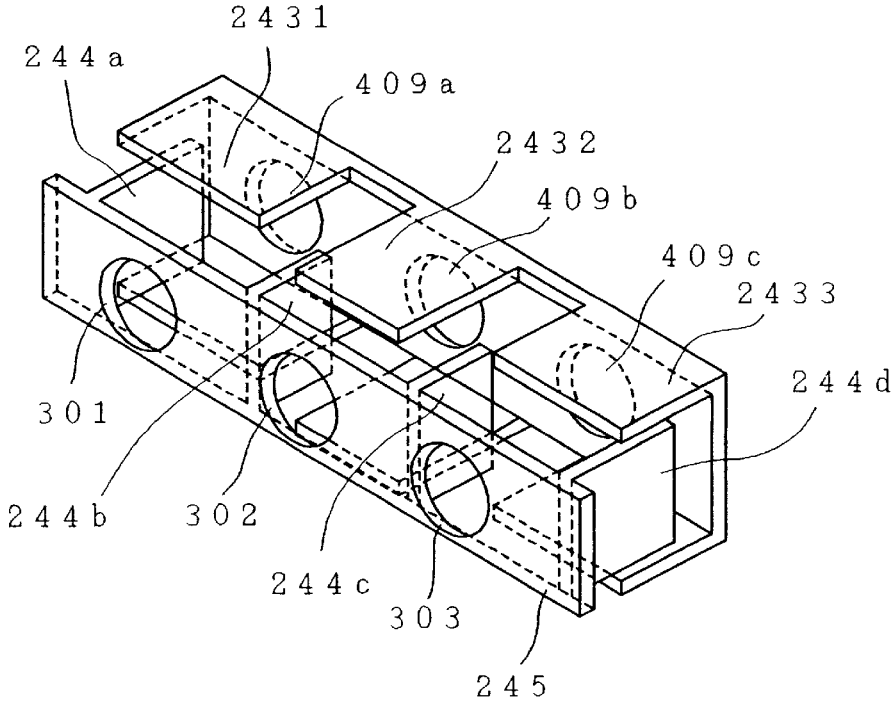
FIG. 12 is a perspective view showing an essential portion of the electron gun for explaining a seventh embodiment of the color cathode ray tube according to the present invention.

FIG. 12 is a perspective view showing an essential portion of the electron gun for explaining a seventh embodiment of the color cathode ray tube according to the present invention. The second plate electrodes 243 are divided for the individual electron beam passing holes into side plate electrodes 2431 and 2433 for the side electron beam passing holes and central plate electrodes 2432 for the central electron beam passing hole.

Moreover, the central plate electrodes 2432 of the second plate electrodes 243 thus divided have a larger axial length than that of the side plate electrodes 2431 and 2433. Still moreover, the paired central plate electrodes may be either folded toward the central electron beam or formed such that the vertical gap of the central one of the three electron beam passages is made smaller than the vertical one of the side electron beam passages.

Thanks to this construction, there can be attained effects similar to those of the aforementioned fourth embodiment.

In case, moreover, the second plate electrodes 243 are thus divided, the present embodiment may be combined with the elongated central aperture, as shown in FIGS. 5 and 6.

Eighth Embodiment

Figure 13:
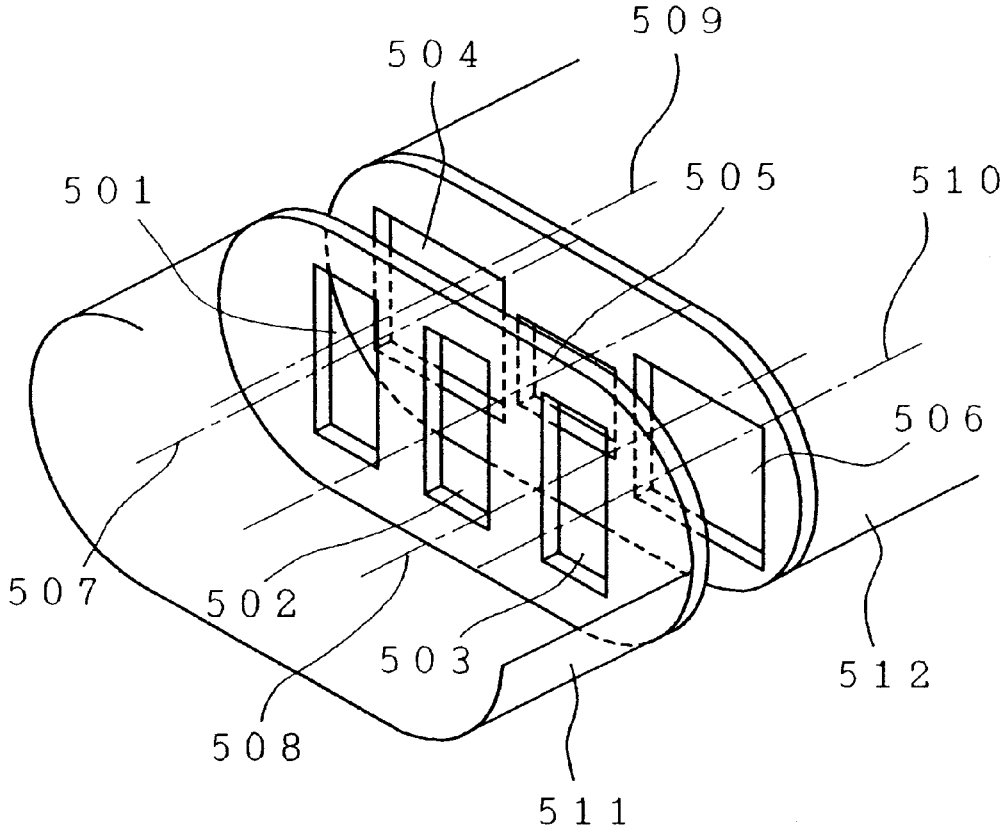
FIG. 13 is a perspective view showing an essential portion of the electron gun for explaining an eighth embodiment of the color cathode ray tube according to the present invention.

FIG. 13 is a perspective view showing an essential portion of the electron gun for explaining an eighth embodiment of the color cathode ray tube according to the present invention. The present invention is applied to an electron gun which has an electrostatic quadrupole lens different from those of the individual foregoing embodiments.

In FIG. 13: reference numeral 511 designates a first kind of focusing electrode constituting the focusing electrode; numeral 512 a second kind of focusing electrode constituting the same; numerals 501, 502 and 503 electron beam passing holes formed in the first kind of focusing electrode 511; numerals 504, 505 and 506 electron beam passing holes formed in the second kind of focusing electrode 512; numerals 507 and 508 the center axes of the side electron beam passing holes 501 and 503 of the first kind of focusing electrode 511; and numerals 509 and 510 the center axes of the side electron beam passing holes 504 and 506 of the second kind of focusing electrode 512.

The vertically longer electron beam passing holes 501, 502 and 503 of the first kind of focusing electrode 511 of the halved focusing electrode and the horizontally longer electron beam passing holes 504, 505 and 506 of the second kind of focusing electrode 512 are arranged to confront each other to form the electrostatic quadrupole lens.

Moreover, the center axes 507 and 508 of the side electron beam passing holes 501 and 503 formed in the first kind of focusing electrode 511 are slightly offset inward with respect to the center axes 509 and 510 of the side electron beam passing holes 504 and 506 formed in the second kind of focusing electrode 512.

Thanks to this offset, the side electron beams can be deflected toward the central electron beam without passing through the sides of the center axis of the lens, to cancel the STC fluctuation by the main lens.

However, the offset reduces the areas of the confronting portions of the electron beam passing holes 501 and 503 of the first kind of focusing electrode 511 and the electron beam passing holes 504 and 506 of the second kind of focusing electrode 512. As a result, the electrostatic quadrupole lens intensity against the side electron beams is increased.

As a result, there arises an unbalance in the astigmatism correction effect for the central electron beam and the side electron beams, as has been described in connection with the embodiment of FIG. 4. In order to eliminate this, the ratio of the horizontal diameter of the central electron beam passing hole 505 of the second kind of focusing electrode 512 to the vertical diagram is made larger than that of the side electron beam passing holes to make a horizontally elongated shape.

As a result, the effect of the horizontally elongated hole shape corrects the electrostatic quadrupole lens intensity against the side electron beams, to eliminate the unbalance of the astigmatism correction sensitivity from the central electron beam.

Incidentally, in this embodiment, the unbalance in the astigmatism correction sensitivity between the side election beams and the central electron beam is corrected at the side of the second kind of focusing electrode, but a similar correction can be made at the side of the first kind of focusing electrode.

In this case, the ratio of the vertical diameter of the central electron beam passing hole 502 of the first kind of focusing electrode 511 to the horizontal diameter may be made larger than that of the side electron beam passing holes.

In the first to eighth embodiments thus far described, the plate electrode to be disposed at the side of the second kind of focusing electrode so as to construct the electrostatic quadrupole lens is composed of a pair of parallel plates with respect to the three electron beams. However, the present invention should not be limited to that construction but may be modified such that each electrode pair may be disposed for each electron beam. Moreover, the plate electrodes should not be limited to the flat plates, but similar effects car apparently be attained in case the quadrupole lens is composed of plate electrodes having a suitable shape such as curved plates, portions of cylinders, or partial cylindrical plates.

Moreover, the foregoing individual embodiments have been described in case the present invention is applied to the electron gun of the type in which the focusing electrode is halved. The present invention should not be limited thereto but can naturally be likewise applied to the construction in which the focusing electrode is composed of a plurality of electrode groups.

As has been described hereinbefore, according to the present invention, in the color cathode ray tube having the dynamic focus type electron gun which has its resolution improved all over the screen including the peripheral portions by having the electrostatic quadrupole lens mounted therein, the unbalance of the astigmatism correction sensitivity, which is caused due to the different intensities of the electrostatic quadrupole lens against the central electron beam and the side electron beams, can be corrected to further improve the resolution all over the screen including the peripheral portions to display an image of a high quality.

What is claimed is:

1. A color cathode ray tube comprising:

an electron gun including an electron beam generating portion arrayed in a horizontal direction for generating three electron beams, and a main lens for focusing said three electron beams from said electron beam generating portion upon a fluorescent face, said electron beam generating portion and said main lens being arrayed along an axis of the cathode ray tube; and a deflection yoke for scanning said three electron beams upon said fluorescent face;

said main lens including an accelerating electrode for being supplied with an accelerating voltage and having three electron beam passages including a central electron beam passage and side electron beam passages;

a focusing electrode for being supplied with a focusing voltage and having three electron beam passages including a central electron beam passage and side electron beam passages;

a final stage of said main lens being formed between said focusing electrode and said accelerating electrode;

said focusing electrode being divided into at least two focusing electrode parts, said at least two focusing electrode parts including a first focusing electrode part located at a cathode side, and a second focusing electrode part located at a fluorescent face side;

wherein one of said first focusing electrode part and said second focusing electrode part is applied with one of a first focusing voltage and a second focusing voltage, and said second focusing voltage is a combination of a static voltage and a dynamic voltage changing according to the deflection of said electron beams;

wherein a quadrupole electron lens is formed for each of said three electron beams between said first focusing electrode part and said second focusing electrode part, and the strength of the quadrupole electron lens for the central electron beam is different from the strength of the quadrupole electron lens for the side electron beams;

wherein said first focusing electrode part and said second focusing electrode part have an opposing side, and said opposing side of one of said first focusing electrode part and second focusing electrode part has an aperture for the central electron beam and apertures for the side electron beams, and a vertical dimension of said aperture for the central electron beam is different from a vertical dimension of said apertures for the side electron beams; and wherein said focusing electrode which together with said acceleration electrode has said final stage of said main lens formed therebetween has a single aperture having a diameter which is larger in a horizontal direction than a diameter thereof in a vertical direction, and said focusing electrode has an electrode plate with a central electron beam aperture.

2. A color cathode ray tube according to claim 1, wherein said second focusing voltage is applied to said second focusing electrode part.

3. A color cathode ray tube according to claim 1, wherein said second focusing voltage is applied to said focusing electrode which together with said acceleration electrode has said final stage of said main lens formed therebetween.

4. A color cathode ray tube according to claim 1, wherein said second focusing electrode part and said focusing electrode which together with said acceleration electrode has said final stage of said main lens formed therebetween are identical to one another.

5. A color cathode ray tube according to claim 1, wherein the strength of said quadrupole electron lens for the central electron beam is stronger than the strength of said quadrupole electron lens for the side electron beams.

6. A color cathode ray tube according to claim 1, wherein, said opposing side of one of said first focusing electrode part and said second focusing electrode part has an aperture for the central electron beam and apertures for the side electron beams, and a vertical dimension of said aperture for the central electron beam is smaller than a vertical dimension of said apertures for the side electron beams.

7. A color cathode ray tube according to claim 1, wherein said opposing side of said first focusing electrode part has an aperture for the central electron beam and apertures for the side electron beams.

8. A color cathode ray tube according to claim 1, wherein said opposing side of both of said first focusing electrode part and said second focusing electrode part have an aperture for the central electron beam and apertures for the side electron beams.

9. A color cathode ray tube according to claim 1, wherein the center of the aperture for a side electron beam of said first focusing electrode and the center of the opposing aperture of the side electron beam of said second focusing electrode are offset with respect to each other in a horizontal direction.

10. A color cathode ray tube according to any one of claims 1, 6, 7, 8 and 9, wherein upper and lower portions of said aperture for the central electron beam and said apertures for the side electron beams at said opposing side of said first focusing electrode and said second focusing electrode are rectangular.

11. A color cathode ray tube according to claim 1, wherein said central electron beam aperture of said plate electrode of said focusing electrode has a larger dimension in the vertical direction than the dimension in the horizontal direction.

12. A color cathode ray tube according to claim 11, wherein said central electron beam aperture is elliptical.

13. A color cathode ray tube comprising:

an electron gun including an electron beam generating portion arrayed in a horizontal direction for generating three electron beams, and a main lens for focusing said three electron beams from said electron beam generating portion upon a fluorescent face, said electron beam generating portion and main lens being arrayed along an axis of the cathode ray tube; and a deflection yoke for scanning said three electron beams upon said fluorescent face;

said main lens including an accelerating electrode for being supplied with an accelerating voltage and having three electron beam passages including a central electron beam passage and side electron beam passages;

a focusing electrode for being supplied with a focusing voltage and having three electron beam passages including a central electron beam passage and side electron beam passages;

a final stage of said main lens being formed between said focusing electrode and said accelerating electrode;

said focusing electrode being divided into at least two focusing electrode parts, said at least two focusing electrode parts including a first focusing electrode part located at a cathode side, and a second focusing electrode part located at a fluorescent face side;

wherein one of said first focusing electrode part and said second focusing electrode part is applied with one of a first focusing voltage and a second focusing voltage, and said second focusing voltage is a combination of a static voltage and a dynamic voltage changing according to the deflection of said electron beams;

wherein a quadrupole electron lens is formed for each of said three electron beams between said first focusing electrode part and said second focusing electrode part, and a diverging lens force in a vertical direction of the quadrupole electron lens for the central electron beam is different from a diverging lens force in the vertical direction of the quadrupole electron lens for the side electron beams;

wherein said first focusing electrode part and said second focusing electrode part have an opposing side, and said opposing side of one of said first focusing electrode part and second focusing electrode part has an aperture for the central electron beam and apertures for the side electron beams, and a vertical dimension of said aperture for the central electron beam is different from a vertical dimension of said apertures for the side electron beams; and wherein said focusing electrode which together with said acceleration electrode has said final stage of said main lens formed therebetween has a single aperture having a diameter which is larger in a horizontal direction than a diameter thereof in the vertical direction, and said focusing electrode has an electrode plate with an central electron beam aperture.

14. A color cathode ray tube according to claim 13, wherein said second focusing voltage is applied to said second focusing electrode part.

15. A color cathode ray tube according to claim 13, wherein said second focusing voltage is applied to said focusing electrode which together with said acceleration electrode has said final stage of said main lens formed therebetween.

16. A color cathode ray tube according to claim 13, wherein said second focusing electrode part and said focusing electrode which together with said acceleration electrode has said final stage of said main lens formed therebetween are identical to one another.

17. A color cathode ray tube according to claim 13, wherein a lens force in the vertical direction of said quadrupole electron lens for the central electron beam is stronger than a lens force in the vertical direction of said quadrupole electron lens for the side electron beams.

18. A color cathode ray tube according to claim 13, wherein said opposing side of one of said first focusing electrode part and said second focusing electrode part has an aperture for the central electron beam and apertures for the side electron beams, and a vertical dimension of said aperture for the central electron beam is smaller than a vertical dimension of said apertures for the side electron beams.

19. A color cathode ray tube according to claim 13, wherein said opposing side of said first focusing electrode part has an aperture for the central electron beam and apertures for the side electron beams.

20. A color cathode ray tube according to claim 13, wherein said opposing side of both of said first focusing electrode part and said second focusing electrode part have an aperture for the central electron beam and apertures for the side electron beams.

21. A color cathode ray tube according to claim 20, wherein a center of the aperture for a side electron beam of said first focusing electrode a nd a center of the opposing aperture of the side electron beam of said second focusing electrode are offset with respect to each other in the horizontal direction.

22. A color cathode ray tube according to any one of claims 13, 18, 19, 20 and 21, wherein upper and lower portions of said aperture for the central electron beam and said apertures for the side electron beams at said opposing side of said first focusing electrode and said second focusing electrode are rectangular.

23. A color cathode ray tube according to claim 13, wherein said central electron beam aperture of said plate electrode of said focusing electrode has a larger dimension in the vertical direction than a dimension thereof in the horizontal direction.

24. A color cathode ray tube according to claim 13, wherein said central electron beam aperture of said plate electrode is elliptical.

* * * * *